US009561600B2

(12) United States Patent
Dröβler et al.

(10) Patent No.: US 9,561,600 B2
(45) Date of Patent: Feb. 7, 2017

(54) KICKBACK REDUCING CHAIN LINK

(75) Inventors: Christian Dröβler, Geislingen (DE); Markus Maag, Neu-Ulm (DE)

(73) Assignee: HUSQVARNA AB, Huskvarna (SE)

( * ) Notice: Subject to any disclaimer, the term of this patent is extended or adjusted under 35 U.S.C. 154(b) by 167 days.

(21) Appl. No.: 13/979,445

(22) PCT Filed: Jan. 13, 2011

(86) PCT No.: PCT/EP2011/050398

§ 371 (c)(1),
(2), (4) Date: Jul. 12, 2013

(87) PCT Pub. No.: WO2012/095177

PCT Pub. Date: Jul. 19, 2012

(65) Prior Publication Data

US 2013/0291702 A1 Nov. 7, 2013

(51) Int. Cl.
*B27B 33/14* (2006.01)

(52) U.S. Cl.
CPC ..... *B27B 33/141* (2013.01); *B27B 33/14* (2013.01); *B27B 33/147* (2013.01); *Y10T 83/925* (2015.04)

(58) Field of Classification Search
CPC ..... B27B 33/02; B27B 33/14; B27B 33/141; B27B 33/142; B27B 33/144; B27B 33/145; B27B 33/00; Y10T 83/9319; Y10T 83/9326; Y10T 83/9329; Y10T 83/9331
USPC ..... 83/830–840
See application file for complete search history.

(56) References Cited

U.S. PATENT DOCUMENTS 3,545,508 A * 12/1970 Tupper ..... 83/833
4,269,100 A * 5/1981 Deelman ..... B27B 33/141 83/834
4,459,890 A * 7/1984 Dolata ..... B27B 33/141 83/830
4,558,621 A * 12/1985 Nitschmann ..... B27B 33/141 83/830

(Continued)

OTHER PUBLICATIONS

International Search Report and Written Opinion of PCT/EP2011/050398 mailed Sep. 6, 2011.

(Continued)

*Primary Examiner* — Jason Daniel Prone
*Assistant Examiner* — Richard Crosby, Jr.
(74) *Attorney, Agent, or Firm* — Nelson Mullins Riley & Scarborough LLP

(57) ABSTRACT

A cutting chain (100) moving in a cutting direction (120) is disclosed in the present invention. The cutting chain (100) includes a cutting link (106), which further includes a cutting portion (120), a depth gauge (118) and a space (122) between the cutting portion (120) and the depth gauge (118). The cutting chain (100) further includes a bumper drive link (104) which is pivotally connected to the cutting link (106) and immediately precedes the cutting link (106) in the cutting direction (124). The bumper drive link (104) further includes a tail (204) and a body (202). The tail (204) of the bumper drive link (104) further includes a bent portion (206) and a straight portion (208). Further, the bent portion (206) is oriented in a substantially perpendicular direction relative to a plane (P) of the body (202) of the bumper drive link (104). Moreover, the bent portion (206) of the tail (204) extends into the space (122) between the cutting portion (120) and the depth gauge (118) of the cutting link (106).

14 Claims, 4 Drawing Sheets

(56) References Cited

U.S. PATENT DOCUMENTS

| | | | | | |
|---|---|---|---|---|---|
| 4,581,968 | A * | 4/1986 | Gibson | B27B 33/141 | 83/833 |
| 4,590,836 | A * | 5/1986 | Doiron | 83/834 | |
| 4,604,932 | A | 8/1986 | Doiron | | |
| 4,608,901 | A | 9/1986 | Doiron | | |
| 4,625,610 | A * | 12/1986 | Petrovich | 83/834 | |
| 4,813,323 | A * | 3/1989 | Harfst | 83/830 | |
| 4,873,903 | A * | 10/1989 | Harfst | 83/830 | |
| 5,651,938 | A * | 7/1997 | Thomson et al. | 420/119 | |
| 5,974,933 | A | 11/1999 | Burrows et al. | | |
| 6,058,825 | A * | 5/2000 | Harfst | 83/834 | |
| 6,748,840 | B2 * | 6/2004 | Harfst | B27B 33/141 | 83/830 |
| 6,871,573 | B2 * | 3/2005 | Mang | B27B 33/141 | 83/830 |
| 7,637,192 | B2 * | 12/2009 | Goettel | B27B 33/141 | 83/830 |
| 8,256,335 | B1 * | 9/2012 | Canon | 83/832 | |
| 9,168,671 | B2 * | 10/2015 | Englund | B27B 33/14 | |
| 2003/0213344 | A1 | 11/2003 | Andress | | |
| 2006/0243097 | A1 * | 11/2006 | Raczykowski | 76/112 | |
| 2008/0011144 | A1 * | 1/2008 | Harfst et al. | 83/830 | |
| 2008/0072733 | A1 * | 3/2008 | Schulz | B27B 33/141 | 83/834 |
| 2008/0098870 | A1 * | 5/2008 | Goettel et al. | 83/834 | |
| 2008/0110317 | A1 * | 5/2008 | Osborne et al. | 83/830 | |
| 2013/0319201 | A1 * | 12/2013 | Schulz | B27B 33/14 | 83/830 |

OTHER PUBLICATIONS

Chapter I International Preliminary Report on Patentability of PCT/EP2011/050398 mailed Jul. 16, 2013.

* cited by examiner

KICKBACK REDUCING CHAIN LINK

TECHNICAL FIELD

The present invention relates to a cutting chain for a chainsaw. In particular, the present invention relates to a chain link used in the cutting chain.

BACKGROUND

Chainsaws are well known in the art, which typically include a cutting chain that rides over a guide bar, a drive sprocket and a nose sprocket, the sprockets being located at two ends of the guide bar. The drive sprocket is driven by a drive shaft whereas the nose sprocket rotates idly. The cutting chain has multiple drive links that have tangs for engaging with the drive sprocket, thereby imparting a motion to the cutting chain. The tangs also extend into a peripheral channel of the guide bar, thereby securing the cutting chain in place during the motion. The drive links also include one or more rivet holes for connection with other components of the cutting chain, such as, cutting links and tie straps. A cutting link may include a cutting portion and an integrally formed depth gauge such that, during operation, the depth gauge leads the cutting portion and controls a depth of cut into a wood portion.

However, while traversing over the nose sprocket the depth gauges may not properly work to control the depth of cut, thereby resulting in a kickback. This is not desirable as it may lead to personal injuries, damage to the chainsaw and improper cutting. In the prior art, modifications in the shape of the drive link for kickback reduction and an improved cutting performance are disclosed. For example, U.S. Pat. No. 7,637,192 issued on Dec. 29, 2009 and assigned to Blount, Inc. titled "Saw chain drive link with tail", discloses a drive link having an extended portion at a tail of the drive link. The extended portion at the tail extends into a space in the gullet region of the cutting link. However, this type of design may not affect the cutting characteristics as the depth gauge setting remains unchanged. Also, there are chances that chips and other debris might get stuck in between the cutting link and the extended portion of the drive link.

In light of the foregoing, there is a need for a design which would control the cutting characteristics reducing the kickback effects along with reduced need for maintenance.

SUMMARY

In view of the above, it is an objective of the present invention to solve or at least reduce the problems discussed above. In particular, the objective is to provide a novel design for a drive link used in a cutting chain of a chainsaw.

The objective is achieved according to a novel cutting chain described in claim 1. The cutting chain, which traverses in a cutting direction, includes at least one cutting link and at least one bumper drive link. The cutting link includes a cutting portion, a depth gauge, and a space in between the cutting portion and the depth gauge. The bumper drive link includes a body and a tail. Further, the bumper drive link is pivotally connected to and precedes the cutting link, in the cutting direction. The tail of the bumper drive link may include a straight portion and a bent portion; and the bent portion is oriented substantially perpendicular relative to a plane of the body of the bumper drive link. The bent portion extends into the space between the cutting portion and the depth gauge. This arrangement reduces kickback occurring during operation of the cutting chain.

According to claim 2, the height of the bent portion is lower then the height of the straight portion.

According to claim 3, the bent portion of the bumper drive link remains below the depth gauge of the cutting link while traversing a straight portion of a guide bar. Due to such an arrangement, the bent portion does not affect a cutting operation of the cutting chain, while the cutting chain is traversing along a straight path on the guide bar.

According to claims 4, the bent portion of the bumper drive link aligns with the depth gauge to form a substantially continuous edge while traversing a nose portion of the guide bar. Further, according to claim 5, the straight portion aligns with the depth gauge of the cutting link. This changes an effective area of the depth gauge, resulting in an improved control of the depth of cut, and reducing kickback effects.

According to claim 6, a free space is provided between the bent portion and the straight portion of the tail. This free space facilitates the elimination of chips from the cut portion, reducing maintenance needs. Further, according to claim 7, the free space between the bent portion and the straight portion of the tail is covered by the depth gauge of the cutter link while traversing a nose portion of a guide bar. This may reduce the occurrence of kickbacks.

According to claim 8, the cutting chain further includes at least one drive link. This drive link does not have the modified bent portion and does not precede any cutting link.

According to claim 9, the cutting chain is adapted to be used in a chainsaw for performing the cutting/sawing operation.

BRIEF DESCRIPTION OF THE DRAWINGS

The invention will in the following be described in more detail with reference to the enclosed drawings, wherein.

DESCRIPTION OF EMBODIMENTS

Figure 1:
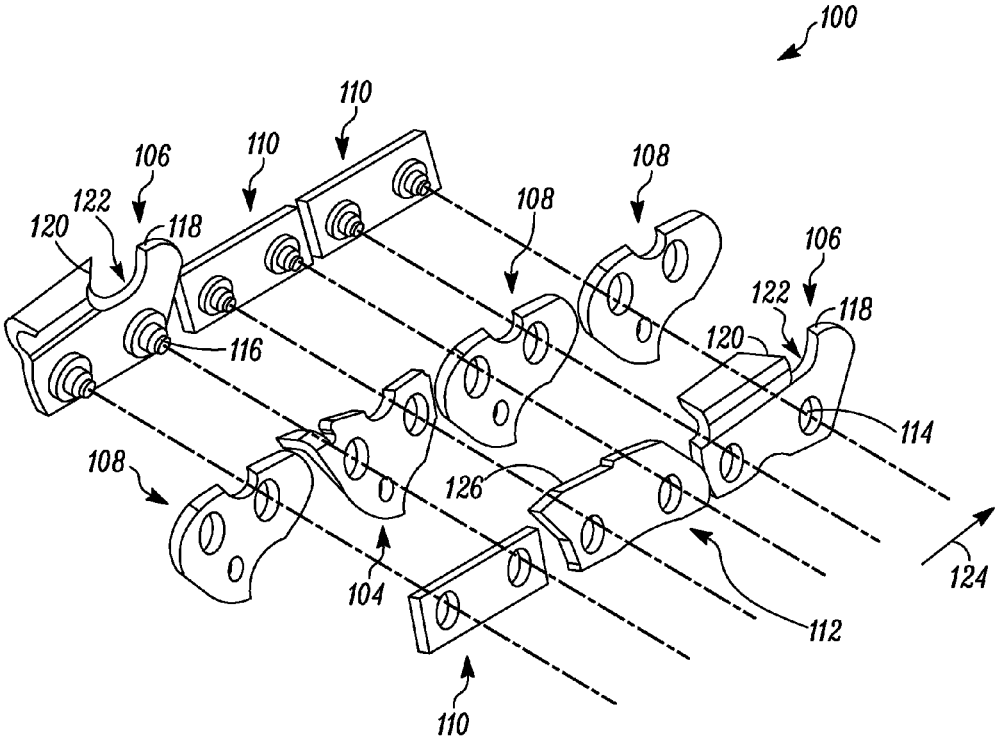
FIG. 1 illustrates an exploded perspective view of a cutting chain, according to an embodiment of the present invention.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention can be utilized in other embodiments and even other types of devices. In the drawings, like numbers refer to like elements.

FIG. 1 illustrates an exploded perspective view of a cutting chain 100, according to an embodiment of the present invention. In an assembled state, the cutting chain 100 may be mounted on a chainsaw (not shown) for performing a cutting/sawing operation. The chainsaw may be of any type, such as, but not limited to, gas powered chainsaw, electric chainsaw, battery driven chainsaw, or the like.

As illustrated in FIG. 1, the cutting chain 100 includes multiple components such as, but not limited to, bumper drive links 104, cutting links 106, drive links 108, side links 110 and bumper side links 112. The plurality of links used in the cutting chain 100 may be manufactured from any material, such as, but not limited to, metals, metallic alloys, composites, or the like. Further, each of the links has apertures 114, which are adapted to pivotally connect the links to each other using fastening members 116 (E.g., rivets).

Typically, a cutting link 106 includes a depth gauge 118, a cutting portion 120, and a space 122 which is provided between the depth gauge 118 and the cutting portion 120. The space 122 between the depth gauge 118 and the cutting portion 120 is henceforth referred to as the gullet 122. The gullet 122 may facilitate a flow chips, produced from a cut portion, out of the cutting chain 100. According to various alternative embodiments of the present invention, the cutting portion 120 of the cutting link 106 may be of different shapes such as, but not limited to, chipper, semi-chisel, chisel and the like. Alternatively, the cutting portion 120 may also include cutting inserts made of suitable material, such as, composites, carbide, diamond, or the like.

Further, the bumper side link 112, following the cutting links 106 in a cutting direction 124, may have a structure with an elevated tail portion 126. This provides stability to the cutting chain 100 and also reduces the kickback effects occurring in the cutting chain 100. The other side links 110 may have a rectangular shape and connect the different components of the cutting chain 100.

According to an embodiment of the present invention, as illustrated in FIG. 1, the bumper drive link 104 precedes the cutting link 106 in the cutting direction 124. The bumper drive link 104 is hereinafter explained in detail in conjunction with FIGS. 2A to 2E.

Figure 2A:
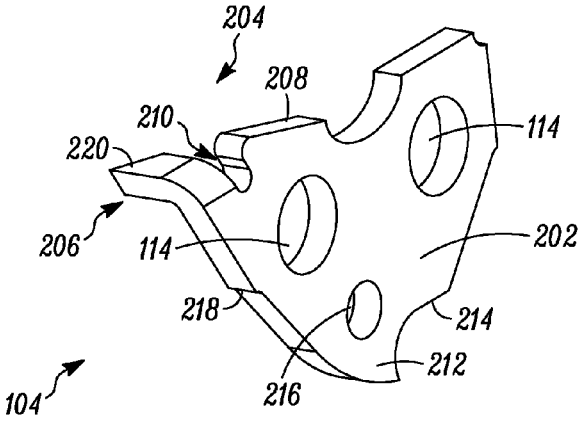
FIG. 2A illustrates a left perspective view of a bumper drive link, according to an embodiment of the present invention.
Figure 2B:
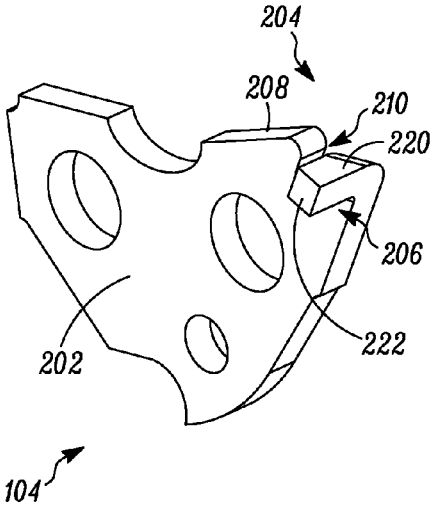
FIG. 2B illustrates a right perspective view of the bumper drive link, according to an embodiment of the present invention.

FIGS. 2A to 2E illustrate various views of the bumper drive link 104, according to an embodiment of the present invention. FIGS. 2A and 2B illustrate perspective views of the bumper drive link 104. The bumper drive link 104 includes a body 202 and a tail 204 such that the tail 204 is located at the top end of the bumper drive link 104. Further, the tail 204 includes a bent portion 206 and a straight portion 208. Moreover, a free space 210 is present between the bent portion 206 and the straight portion 208. The free space 210 may enable to produce the bent portion 206 without affecting the straight portion 208, thereby simplifying a manufacturing process of the bumper drive link 106. Thus, the free space 210 may be made as small as possible. In an alternative embodiment of the present invention, the free space 210 may not be present, and the bent portion 206 and the straight portion 208 are joined. The bumper drive link 104 also includes a tang 212 which may engage with a peripheral groove of the guide bar, a drive sprocket (not shown) and a nose sprocket (as illustrated in FIG. 3). The tang 212 includes a curved section 214 for one or more purposes, such as, but not limited to, distribution of lubricant, providing an exit for the dust/chips reducing the maintenance needs, and the like. The bumper drive link 104 also includes an additional aperture 216 in addition to the apertures 114 for the fasteners. The additional aperture 216 may facilitate distribution of lubricant. Additionally, a notch 218 is also provided to facilitate expulsion of dust/chips and/or distribution of lubricant.

According to an embodiment of the present invention, the bent portion 206 is substantially perpendicular to a plane of the body 202 of the bumper drive link 104. Further, the bent portion 206 includes a top surface 220 which have a quadrilateral shape, as illustrated in FIG. 2A. However, the top surface 220 may have any shape, for example, but not limited to, triangular, pentagonal, or the like within the scope of the present invention. Further, the top surface 220 may also be curvilinear. Moreover, as illustrated in FIG. 2B, a front surface 222 of the bent portion 206 has a substantially parallelogram shape. However, the front surface 222 may be of any shape, for example, but not limited to, rectangular, oval, or the like.

Figure 2E:
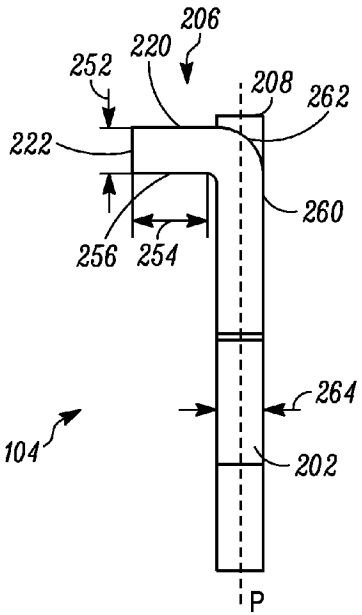
FIG. 2E illustrates a rear elevation view of the bumper drive link, according to an embodiment of the present invention.
Figure 2C:
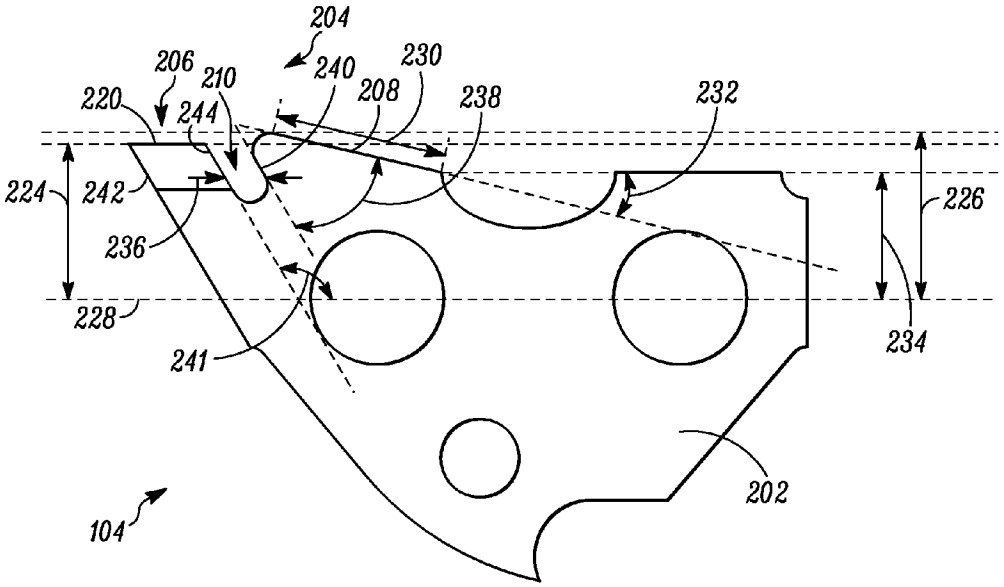
FIG. 2C illustrates a side elevation view of the bumper drive link, according to an embodiment of the present invention.

As illustrated in FIG. 2C, a height 224 of the bent portion 206 may be lower than a maximum height 226 of the straight portion 208. All the heights are measured with respect to a baseline 228 which is a horizontal line passing through the centres of the apertures 114. In an embodiment of the present invention, the height 224 of the bent portion 206 is about 4.4 mm. Further, the maximum height 226 of the straight portion 208 is about 4.7 mm. Moreover, the maximum height 226 of the straight portion 208 may be substantially equal to a height of the depth gauge 118 of the cutting link 106 when the chain 100 is traversing a nose portion of the guide bar (illustrated in FIGS. 3A and 3B). The straight portion 208 also extends over a length 230 such that the straight portion 208 is inclined at an angle 232 with respect to the baseline 224. A minimum height 234 of the straight portion 208 is about 3.6 mm while the length 230 of the straight portion 208 is about 4.9 mm. Further, the angle 232 is about 13°. Moreover, a length 236 of the free space 210 is about 1.2 mm. An angle 238 between the straight portion 208 and an intermediate portion 240 is about 46°. An angle 241 between edges 242 and 244 of the bent portion 206, and the baseline 228 is about 121°.

Figure 2D:
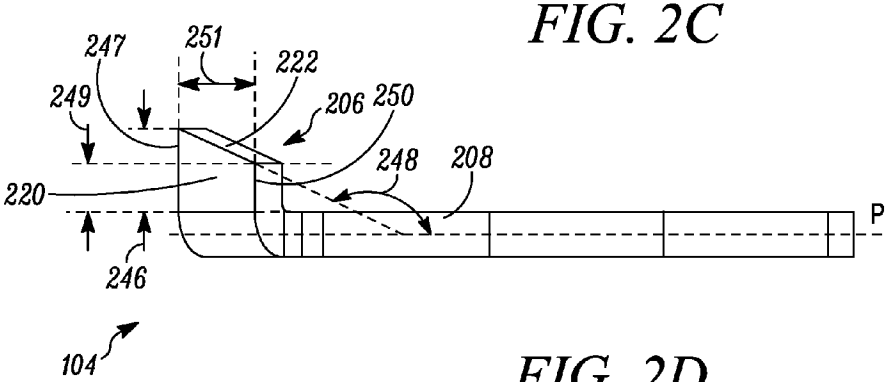
FIG. 2D illustrates a top view of the bumper drive link, according to an embodiment of the present invention.

As illustrated in FIG. 2D, a length 246 of a first side 247 of the top surface 220 is about 2.4 mm. Further, the front surface 222 is inclined at an angle 248 with respect to the plane P of the body 202 such that a length 249 of the second side 250 of the top surface 220 is lower than the length 246 of the first side 247. The angle 248 is about 155°. Further, the length 249 of the second side 250 is about 1.4 mm. Moreover, a width 251 of the top surface 220 parallel to the plane P lies between is about 2.2 mm.

As illustrated in FIG. 2E, a thickness 252 of the bent portion 206 is about 1.3 mm. Further, a side length 254 of a bottom surface 256 of the bent portion 206 is about 2.1 mm. Further, the side length 254 may be such that the bent portion 206 is at a maximum covering the width of the cutting portion 120 of the trailing cutting link 106. Preferably the length 254 is less (most preferably just slightly less) than the width of the cutting portion 120 thus allowing the cutting portion 120 still to cut into wood even when being partially covered by the bent portion 206.

It may be apparent to a person ordinarily skilled in the art that the dimensions disclosed above are purely exemplary in nature, and various parts of the bumper drive link 104 may have any other dimensions within the scope of the present invention.

As illustrated in FIG. 2E, a juncture section 260 connects the bent portion 206 of the bumper drive link 104 to the body 202 of the bumper drive link 104. The juncture section 260 is shown to be substantially straight. However, in an alternative embodiment of the present, the juncture section 260 may be inclined at an angle with respect to the plane P of the body 202, such that the juncture section 260 is bent away from the bent portion 206. This may reduce the tension applied at a juncture bend 262, where the bent portion 206 is mounted on the juncture section 260 of the bumper drive link 104. This may safeguard the bent portion 206 against breakage due to stress encountered while performing a cutting operation.

In a further embodiment of the present invention, a thickness of the juncture bend 262 may be more then a thickness 264 of the body 202. This may further improve the mounting strength of the bent portion 206 on the body 202. Moreover, at the juncture bend 262, a convex projecting member may bulge in the direction of the bent portion 206. This may shift the tension point from the farther end of the bent portion 206 towards the body 202 of the bumper drive link 104. This may further increase the resistance of the bent portion 206 against breakage.

Figure 3A:
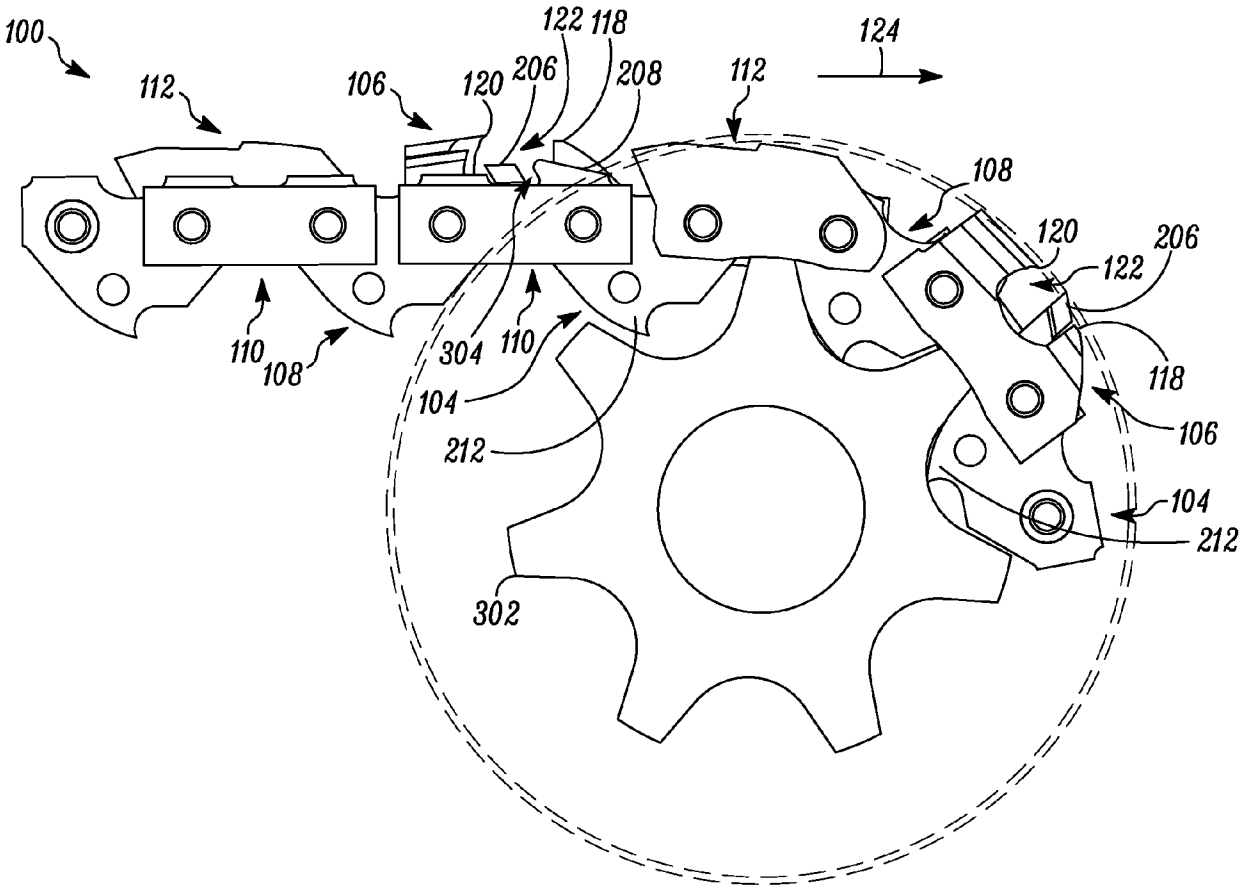
FIG. 3A illustrates a right side elevation view of the cutting chain riding on a nose sprocket, according to an embodiment of the present invention.
Figure 3B:
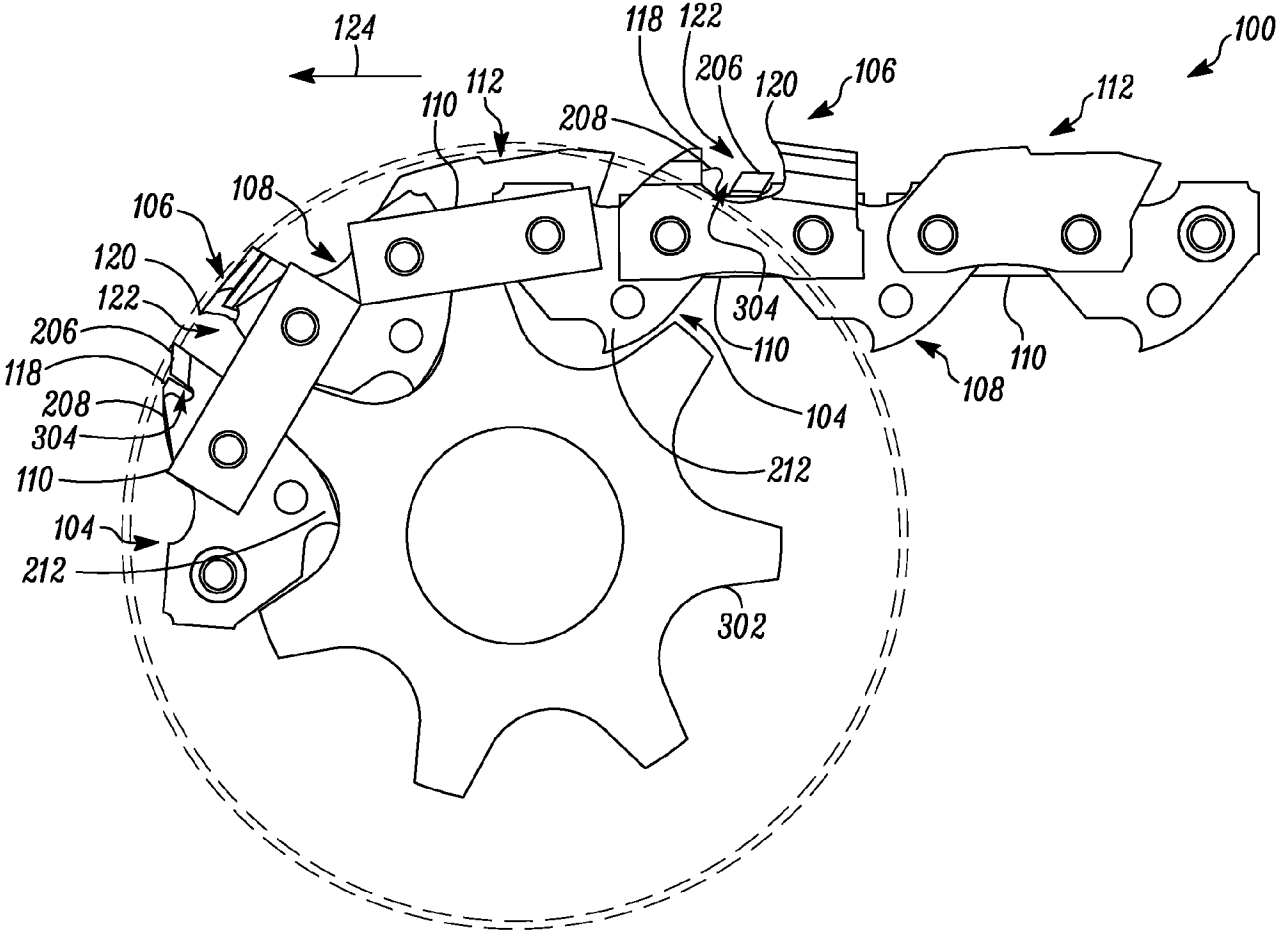
FIG. 3B illustrates a left side elevation view of the cutting chain riding on a nose sprocket, according to an embodiment of the present invention.

FIGS. 3A and 3B illustrate a portion of the cutting chain 100 traversing over a nose portion from a straight portion of the guide bar. In the nose portion of the guide bar, the cutting chain 100 travels over a nose sprocket 302. Further, the tang 212 of the bumper drive link 104 engages with the nose sprocket 302. As illustrated in FIGS. 3A and 3B, the bent portion 206 of the bumper drive link 104 extends into the gullet 122 on the cutting link 106. Further, the bent portion 206 is located below the depth gauge 118 of the cutting link 106 while the cutting chain 100 is traversing along the straight portion of the guide bar. This arrangement may be such that it may not affect the operation of the chainsaw, while the cutting chain 100 is traversing along the straight portion of the guide bar. Moreover, an additional space 304 is present between the bent portion 206 and the depth gauge 118 facilitates ejection of chips and debris generated during the cutting operation.

However, relative spacing between the bumper drive link 104 and the cutting link 106 is such that the bent portion 206 of the bumper drive link 104 aligns with the depth gauge 118 of the cutting link 106 while traversing the nose sprocket 302. Further, the bent portion 206 may form a continuous edge with the depth gauge 118 of the cutting link 106. Thus, an effective area of the depth gauge 118 increases and this may provide improved depth of cut control, thereby reducing kickback. Further, the bent portion 206 extends above the depth gauge 118 when the bent portion 206 of the bumper drive link 104 aligns with the depth gauge 118 of the cutting link 106. Moreover, the free space 210 between the bent portion 206 and the straight portion 208 is covered by the depth gauge 118. The height of the straight portion 208 also becomes substantially to the height of the the depth gauge 118 such that the straight portion 208 laterally aligns with the depth gauge 118 while traversing the nose sprocket 302. As a result, the effective area of the depth gauge 118 further increases, thereby reducing the occurrence of kickbacks. It may also be apparent from FIGS. 3A and 3B that the bent portion 206 extends above the cutting portion 120 of the cutting link 106 while traversing the nose sprocket 302.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A cutting chain movable in a cutting direction over a guide bar, the guide bar having a straight portion and a nose portion, wherein the cutting chain comprises:

at least one cutting link comprising a cutting portion, a depth gauge, and a space between the cutting portion and the depth gauge; and at least one bumper drive link immediately preceding the cutting link in the cutting direction and pivotally connected to the cutting link, wherein the bumper drive link comprises a tail and a body, wherein the tail of the bumper drive link comprises a bent portion, a straight portion, and a free space, the bent portion, the straight portion, and the free space of the tail being located on a top end of the bumper drive link, wherein the bent portion is oriented substantially perpendicular relative to a plane of the body of the bumper drive link;

wherein the bent portion extends into the space between the cutting portion and the depth gauge of the cutting link;

wherein the free space is provided between the bent portion and the straight portion of the tail, an outer most edge of the bent portion being inwardly located in relation to an outer most edge of the depth gauge relative to the guide bar while the cutting chain traverses the straight portion of the guide bar; and wherein the free space is substantially covered by the depth gauge of the cutting link while traversing the nose portion of the guide bar.

2. The cutting chain according to claim 1, wherein a height of the bent portion of the bumper drive link is lower than a height of the straight portion.

3. The cutting chain according to claim 1, wherein when the bent portion of the bumper drive link traverses the straight portion of the guide bar, the bent portion of the bumper drive link remains below the depth gauge of the cutting link.

4. The cutting chain according to claim 1, wherein when the bent portion of the bumper drive link traverses the nose portion of the guide bar, the bent portion of the bumper drive link aligns with the depth gauge to form a substantially continuous edge.

5. The cutting chain according to claim 1, wherein when the straight portion of the bumper drive link traverses the nose portion of the guide bar, the straight portion of the bumper drive link aligns with the depth gauge of the cutting link.

6. The cutting chain according to claim 1, wherein when the bent portion of the bumper drive link traverses the nose portion of the guide bar, the bent portion extends above the cutting portion of the cutting link.

7. A bumper drive link for a cutting chain movable in a cutting direction over a guide bar, the guide bar having a straight portion and a nose portion, the bumper drive link comprising, a body having a plane; and a tail of the bumper drive link, comprising a bent portion, a straight portion, and a free space, the bent portion, the straight portion, and the free space of the tail being located on a top end of the bumper drive link;

wherein the bent portion is oriented substantially perpendicular relative to the plane of the body of the bumper drive link and fits to extend into a space between a cutting portion and a depth gauge of a cutting link;

wherein the free space is provided between the bent portion and the straight portion of the tail, an outer most edge of the bent portion being inwardly located in relation to an outer most edge of the depth gauge relative to the guide bar while the cutting chain traverses the straight portion of the guide bar; and wherein the free space is substantially covered by the depth gauge of the cutting link while traversing the nose portion of the guide bar.

8. The bumper drive link for a cutting chain of claim 7, wherein a height of the bent portion is lower then a height of the straight portion.

9. The cutting chain according to claim 7, wherein the cutting chain is adapted to be used with a chainsaw.

10. The cutting chain according to claim 1, wherein a length of the free space is about 1.2 mm.

11. The cutting chain according to claim 1, wherein when the bent portion of the bumper drive link traverses the nose portion of the guide bar, a relative spacing between the bumper drive link and the cutting link is such that the bent portion of the bumper drive link aligns with the depth gauge of the cutting link.

12. The bumper drive link for a cutting chain of claim 7, wherein a length of the free space is about 1.2 mm.

13. The bumper drive link for a cutting chain of claim 7, wherein when the bent portion of the bumper drive link traverses the nose portion of the guide bar, a relative spacing between the bumper drive link and the cutting link is such that the bent portion of the bumper drive link aligns with the depth gauge of the cutting link.

14. The bumper drive link for a cutting chain of claim 7, wherein a juncture section of the bumper drive link connects the bent portion of the bumper drive link to the body of the bumper drive link.

* * * * *